US006601815B2

(12) United States Patent
Thompson

(10) Patent No.: US 6,601,815 B2
(45) Date of Patent: Aug. 5, 2003

(54) ADJUSTABLE TRAY AND METHOD OF USING THE SAME

(75) Inventor: Harvey Lewis Thompson, Siler City, NC (US)

(73) Assignee: Hooker Furniture Corporation, Martinsville, VA (US)

( * ) Notice: Subject to any disclaimer, the term of this patent is extended or adjusted under 35 U.S.C. 154(b) by 127 days.

(21) Appl. No.: 09/826,196

(22) Filed: Apr. 4, 2001

(65) Prior Publication Data

US 2002/0145098 A1 Oct. 10, 2002

(51) Int. Cl.[7] ..... A47B 97/04

(52) U.S. Cl. ..... 248/460; 248/918; 248/286.1; 248/447

(58) Field of Search ..... 211/11; 248/447, 248/455, 457, 298.1, 460, 918, 286.1, 285.1; 108/13, 102, 97, 50.01

(56) References Cited

U.S. PATENT DOCUMENTS

| | | | | | |
|---|---|---|---|---|---|
| 1,893,720 | A | | 1/1933 | Vandervoort | |
| 2,346,919 | A | * | 4/1944 | Hillenbrand | 108/50.15 |
| 2,414,433 | A | | 1/1947 | Bargen | |
| 2,499,713 | A | | 3/1950 | Bargen | |
| 2,893,533 | A | | 7/1959 | Childs | |
| D246,403 | S | | 11/1977 | Tempchin | |
| 4,116,413 | A | * | 9/1978 | Andersen | 248/451 |
| 4,657,214 | A | | 4/1987 | Foster | |
| 4,712,760 | A | | 12/1987 | Winter | |
| D295,589 | S | | 5/1988 | Walker | |
| 4,776,552 | A | | 10/1988 | March | |
| 4,978,096 | A | * | 12/1990 | Struckmann | 24/18 |
| 5,253,840 | A | | 10/1993 | Sheremetta | |
| 5,294,103 | A | | 3/1994 | Chou | |
| 5,353,049 | A | | 10/1994 | Ro et al. | |
| D359,987 | S | | 7/1995 | Yoshikawa | |
| D367,377 | S | | 2/1996 | Langton et al. | |
| 5,533,702 | A | | 7/1996 | Koch | |
| 5,601,270 | A | | 2/1997 | Chen | |
| 5,607,213 | A | | 3/1997 | Slivon et al. | |
| D397,151 | S | | 8/1998 | Schultz et al. | |
| 6,034,866 | A | * | 3/2000 | Nobuchi et al. | 248/298.1 |
| 6,109,585 | A | | 8/2000 | Burch, Jr. | |
| 6,158,829 | A | | 12/2000 | Nielsen | |

* cited by examiner

*Primary Examiner*—Kimberly Wood
(74) *Attorney, Agent, or Firm*—Hunton & Williams

(57) ABSTRACT

The article of the invention is a tray for a furniture unit of the type used as a workstation. The tray has a base with two supports attached to parallel sides of the base. The supports are in slidable, rotatable communication with a support member which may be moved between a substantially upright and a substantially co-planar position with respect to the base. In the substantially upright position, the support member may support copy such as documents or a book, for example. In the co-planer position, the support member may function as a writing surface or as a shelf for supporting small articles and the like.

26 Claims, 9 Drawing Sheets

ADJUSTABLE TRAY AND METHOD OF USING THE SAME

1. FIELD OF THE INVENTION

The invention generally relates to an adjustable tray. More particularly, the invention relates to a tray for a furniture unit of the type used for a work station.

2. BACKGROUND OF THE INVENTION

The wide spread use of computers has created a need for work stations which can accommodate computer equipment and provide a convenient environment in which an individual may utilize the computer equipment. One problem encountered in providing a convenient environment for utilization of the computer equipment is the problem of positioning a book or document in a position so that the person working at the computer work station can conveniently transcribe or edit materials on the computer without having to turn to one side to look at a document, i.e., an in-line document holder. The general limitation to providing an in-line document holder at a computer work station is a lack of depth of the traditional work surface. A conventional document holder does not fit into the limited space between a key board and a monitor.

Thus, it would be desirable to have an in-line document holder which can hold a document or book in a position convenient for viewing the document and the computer monitor without requiring the operator's head to turn.

3. SUMMARY OF THE INVENTION

The present invention is an adjustable tray. In one exemplary embodiment the tray may be used in a furniture unit of the type suitable for use as a work station. The tray has a base with two supports attached to parallel sides of the side of the base. The supports extend upward in a direction substantially normal to the base. A support member is slidable and rotatable connected to the two supports. The support member is moveable between a position substantially upright with respect to the base and a position substantially co-planar with the base. In the substantially upright position, the support member may support copy such as documents or a book, for example. In the co-planar position, the support member may serve as a writing surface or as a shelf for supporting small articles and the like.

The tray may optionally include features facilitating its use as a portion of a work station including, but not limited to, at least one storage compartment, a wrist support pad and the like.

4. BRIEF DESCRIPTION OF THE DRAWINGS

The present invention can be more fully understood by reading the following detailed description of presently preferred embodiments together with the accompanying drawings, in which like reference indicators are used to designate like elements, and in which.

Figure 14:
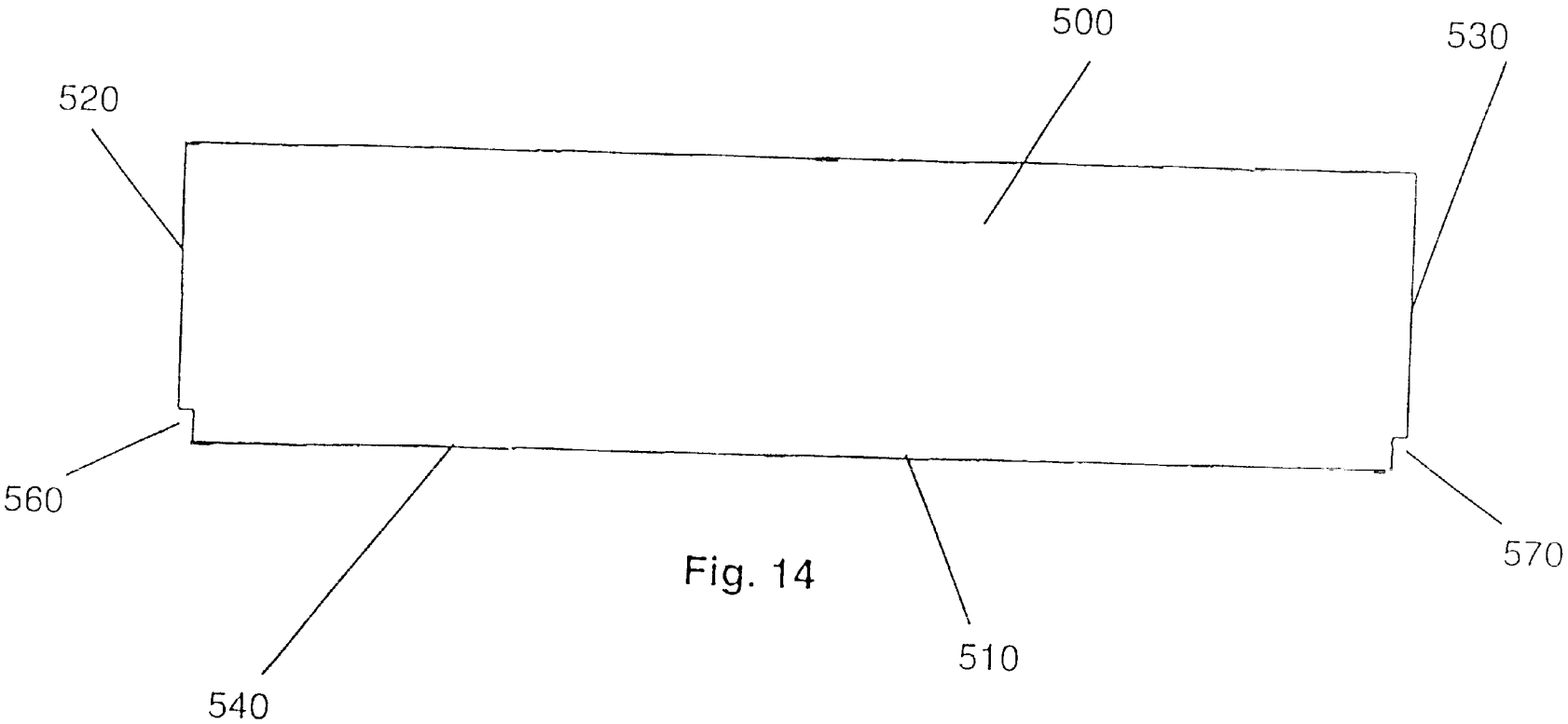
Figure 15:
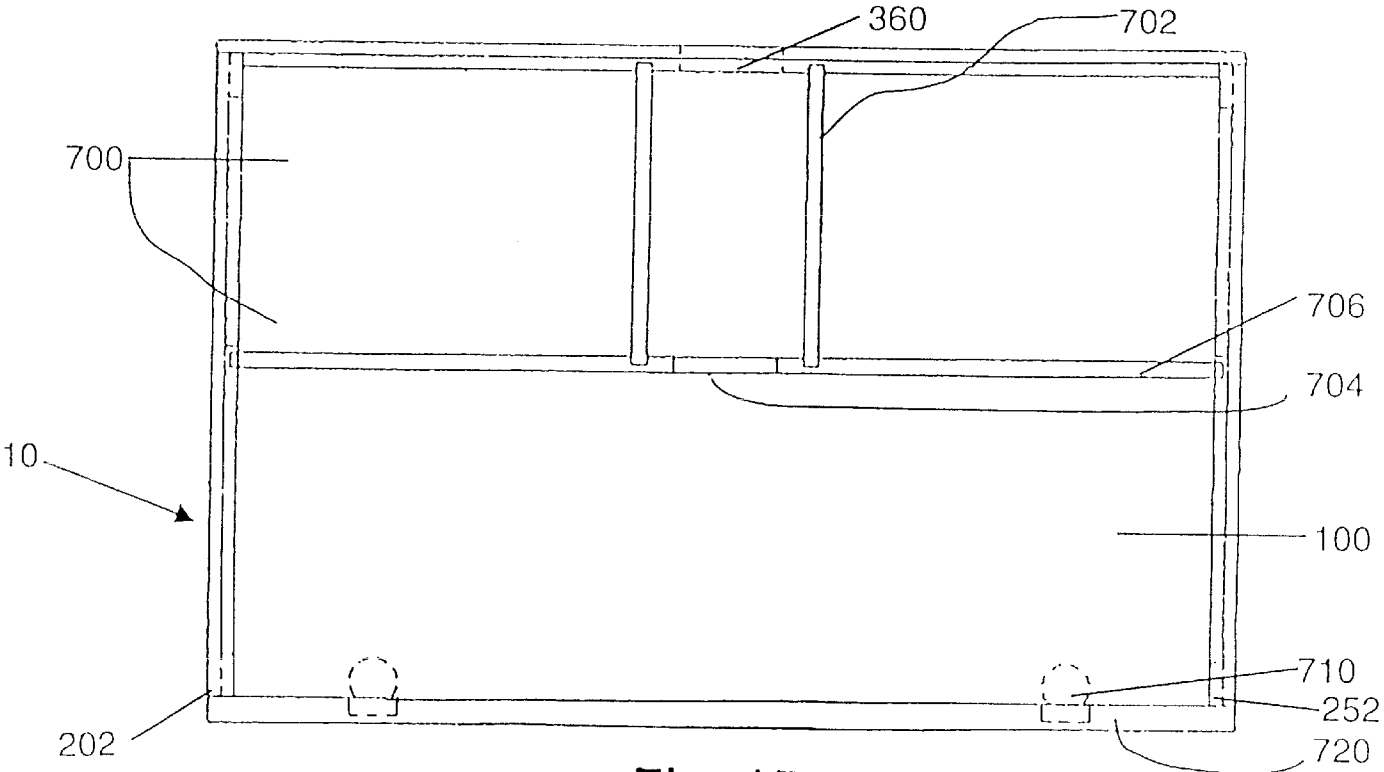
Figure 16:
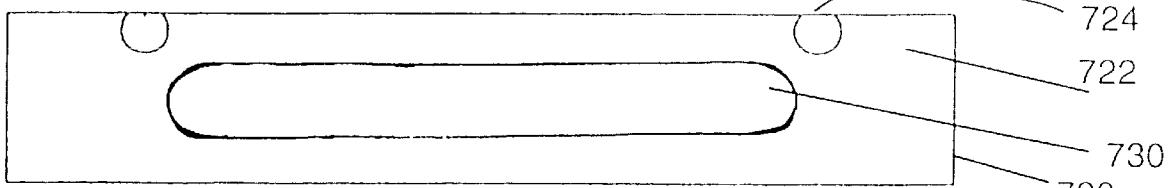

FIG. 14 is a drawing showing a detailed view of a support member of one embodiment of having a moveable support member, in accordance with one embodiment of the invention; and FIG. 15 is a drawing showing a tray having a moveable support member and including storage compartments and a movable front panel, in accordance with one embodiment of the invention; and FIG. 16 is a drawing showing a detailed view of a movable front panel for a tray having a movable support member.

5. DETAILED DESCRIPTION OF THE INVENTION

The invention is directed towards an adjustable tray. In an exemplary embodiment the tray may be used in a furniture unit of the type used as a computer work station. The tray includes a slidable, rotatable support member which may be used in a substantially upright position to support copy such as pieces of paper or a book, for example, or which may be used in a horizontal position as a writing surface or as a shelf for supporting a small article, and the like. Optionally, in selected embodiments of the invention, the support member may be positioned at a position intermediate between horizontal and upright. The tray may be part of a pull-out portion of the unit of furniture or may be a component of the unit of the furniture in a fixed position. Alternatively, the tray of the invention may be used as a lap desk. Optionally, the tray may include additional features facilitating its use as a portion of a workstation, including, but not limited to, at least one storage compartment, a wrist support pad, a front panel and the like.

Figure 1:
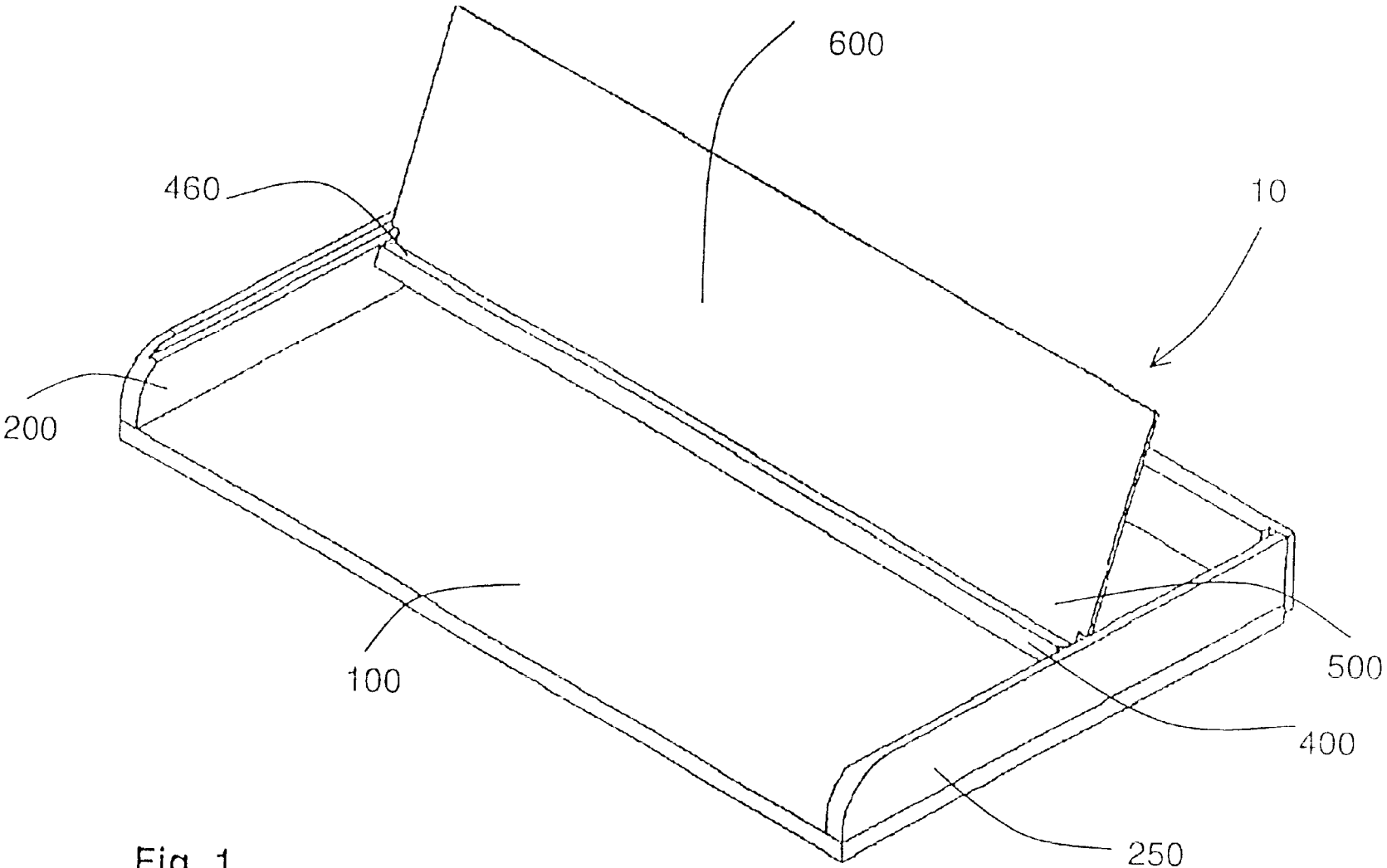
FIG. 1 is a drawing showing a tray having a moveable support member, the moveable support member being shown in a substantially vertical position, in accordance with one embodiment of the invention.

The tray 10 in accordance with an embodiment of the invention is shown in FIG. 1. As shown in FIG. 1, the tray 10 has a support member 500. This support member 500 may be in a substantially vertical or upright position as shown in FIG. 1. When in a substantially vertical position, the support member 500 may support copy such as papers or a book, in a position convenient for reading while using a keyboard and monitor of a computer system, for example. The support member 500 is movable and may be altered in position.

Figure 2:
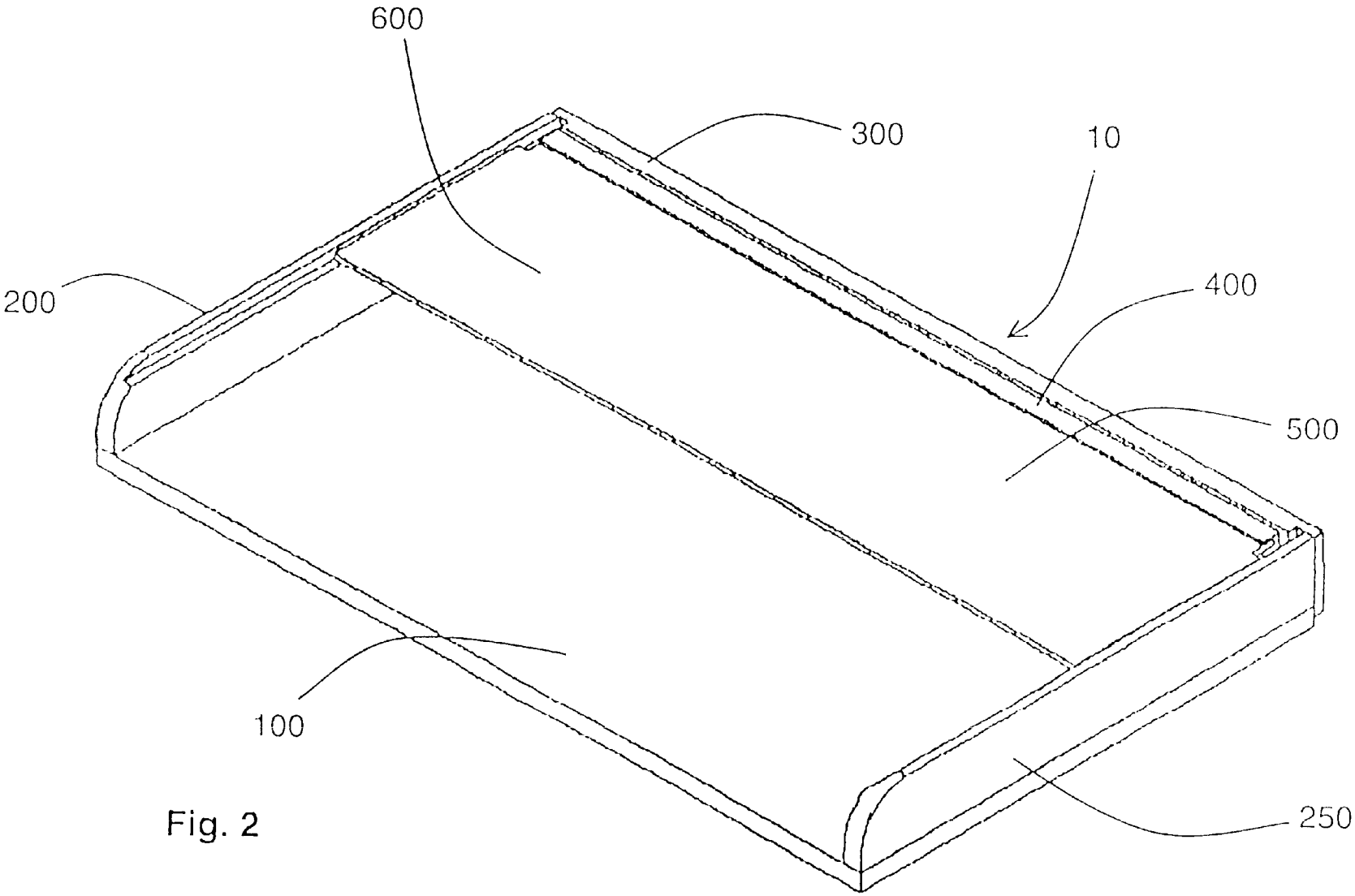
FIG. 2 is a drawing showing a tray having a moveable support member, the moveable support member being shown in a substantially horizontal position, in accordance with one embodiment of the invention.

As shown in FIG. 2, sliding and rotating the support member 500 from its substantially vertical position results in the support member 500 assuming a substantially horizontal position. In the substantially horizontal position, the support member 500 may be used as a writing surface or as a shelf for support of small articles and the like.

Figure 3:
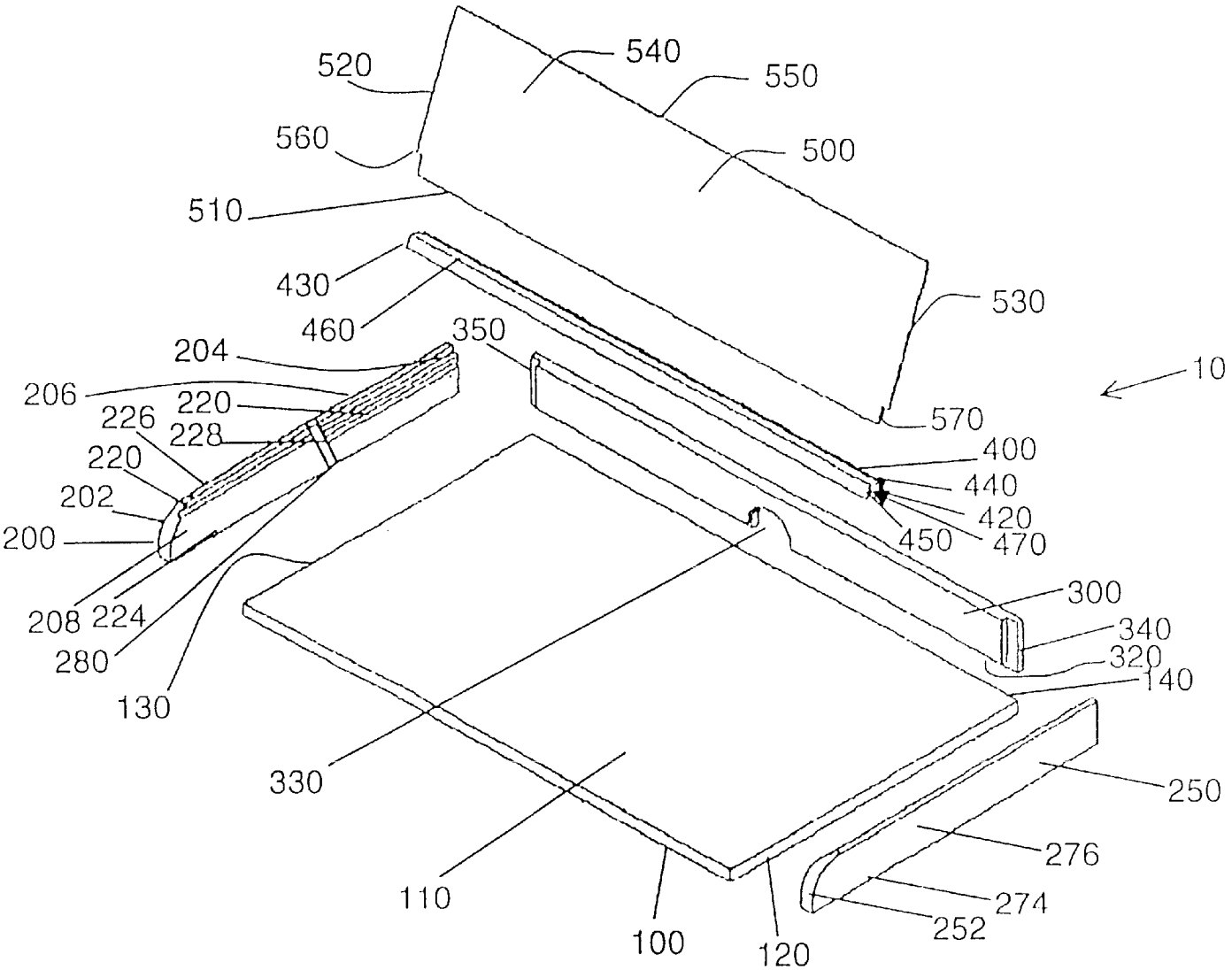
FIG. 3 is a drawing showing an exploded view of the component parts of a tray having a moveable support member, in accordance with one embodiment of the invention.
Figure 4:
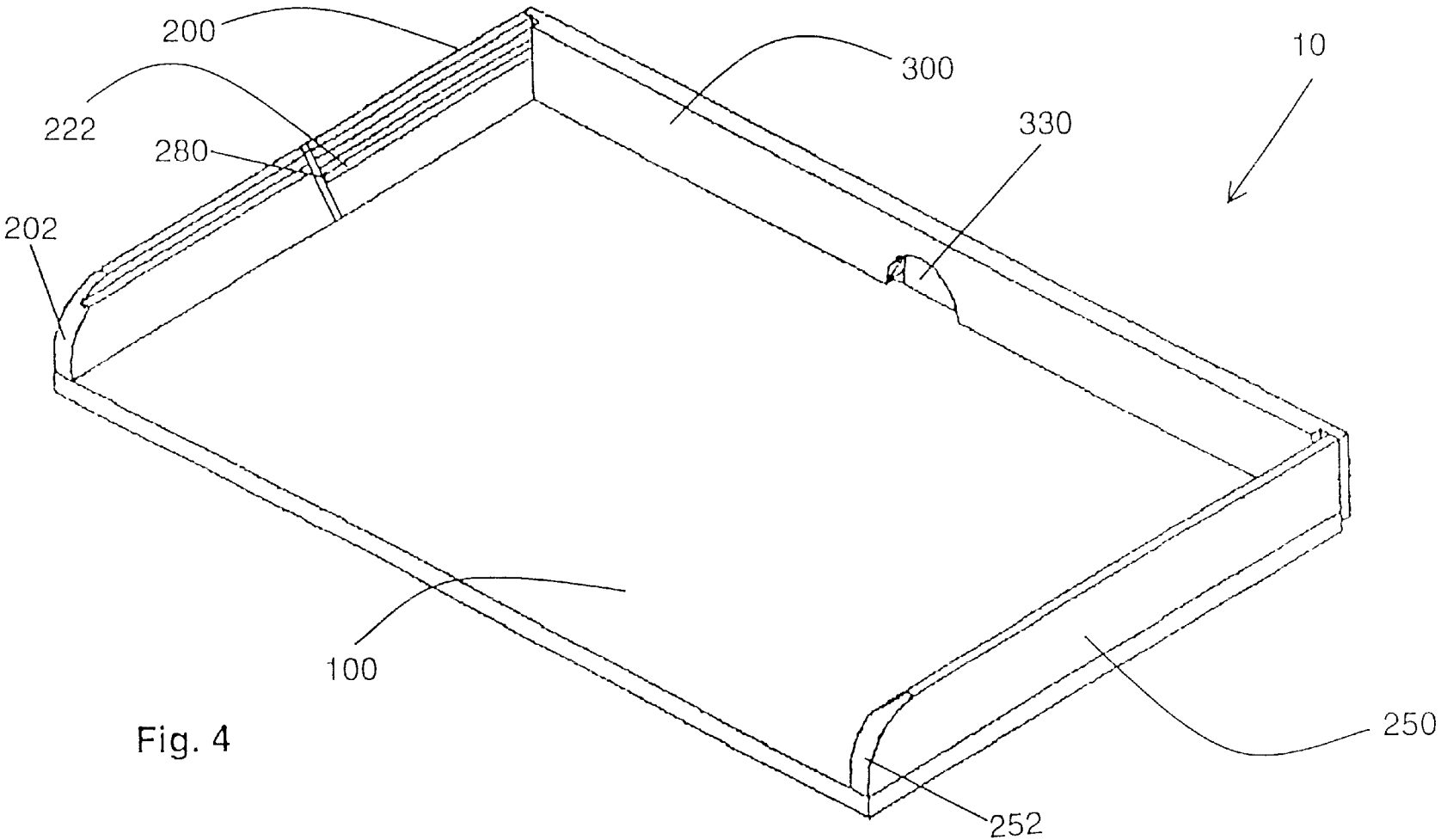
FIG. 4 is a drawing showing a view of the base, back and sides of an assembled tray having a movable support member, in accordance with one embodiment of the invention.
Figure 7:
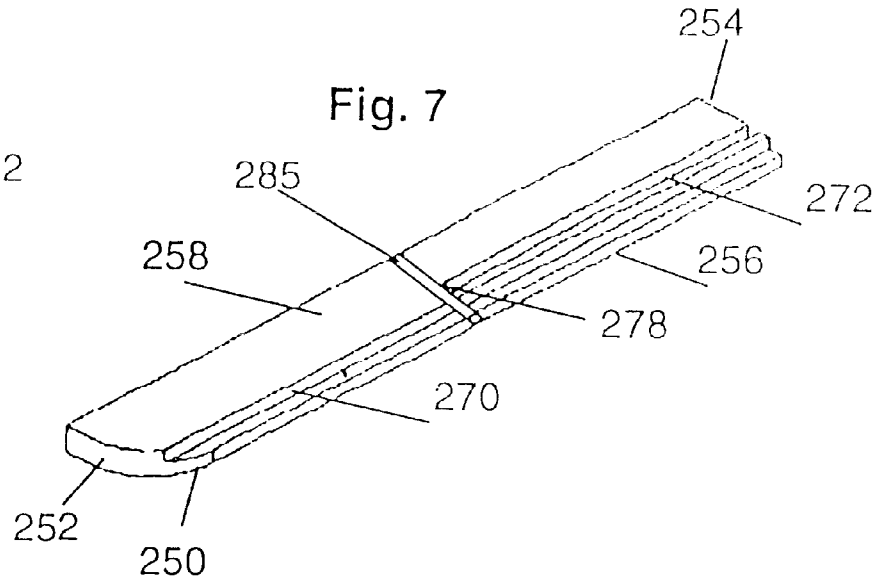
FIG. 7 is a drawing showing a perspective view of a side wall inner portion of a tray having a moveable support member, in accordance with one embodiment of the invention.
Figure 6:
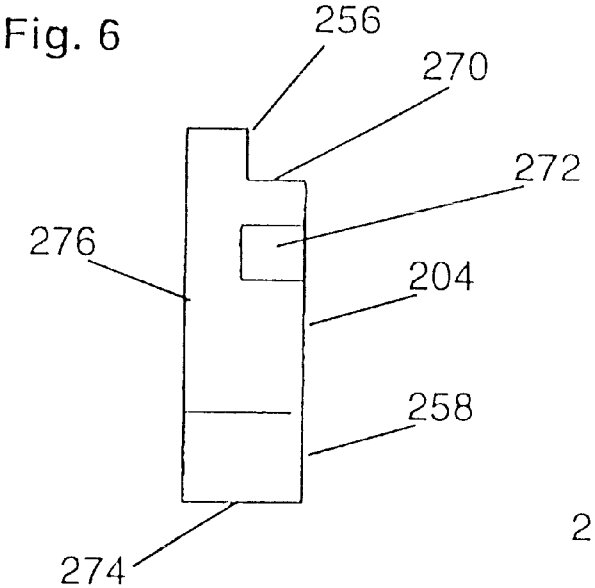
FIG. 6 is a drawing showing a detailed view of the cross-section of a back side wall end of a side wall of a tray having a moveable support member, in accordance with one embodiment of the invention.

Referring to FIG. 3, an exemplary embodiment of the tray 10 will be described in detail. The tray 10 has a base 100, two side walls 200, 250, a back 300, a support bar 400, and a support member 500. FIG. 3 shows the component parts of the tray 10 in an unassembled condition. The back 300, side walls 200, 250 and base 100, of the tray 10 are shown in FIG. 4 in an assembled condition.

Again referring to FIG. 3, the base 100 is generally rectangular and has two base sides 120, 130, a rear base edge 140, and an base support surface, 110. The base sides 120, 130, join the side walls 200, 250, at side wall bases 224, 274. The rear base edge 140 is attached to the back 300 at the lower back edge 320. When the tray 10 is used to support an object such as a keyboard, for example, the object is placed on the base support surface 110.

The back 300, as shown in FIGS. 8–11, has a lower back edge 320, a cut out 330, and two back ends 340, 350. The cut out 330 defines a back aperture 360. The aperture 360 may accommodate the passage of objects such as cords associated with a computer keyboard or computer mouse, for example. The back ends 340, 350 abut the side walls 200, 250. The back ends 340, 350 may be shaped to facilitate close communication between the back ends 340, 350 and the side walls 200, 250. As one skilled in the art will appreciate, a variety of shapes may be used. In the exemplary embodiment shown in FIG. 10, the back 300 has an outer back portion 370 that extends beyond an inner back portion 372 such that back corner recesses 374, 376 are formed at the back ends 340, 350. The back corner recesses 374, 376 abut the side walls, 200, 250.

Referring again to FIG. 3 and FIGS. 5–7, the side walls 200, 250 each have a front side wall end 202, 252, a back side wall end 204, 254, side wall top 206, 256, an inner sidewall portion 208, 258, an outer sidewall portion 226, 276, a recessed sidewall edge 220, 270, a sidewall base 224, 274, and a slot 222, 272.

Figure 5:
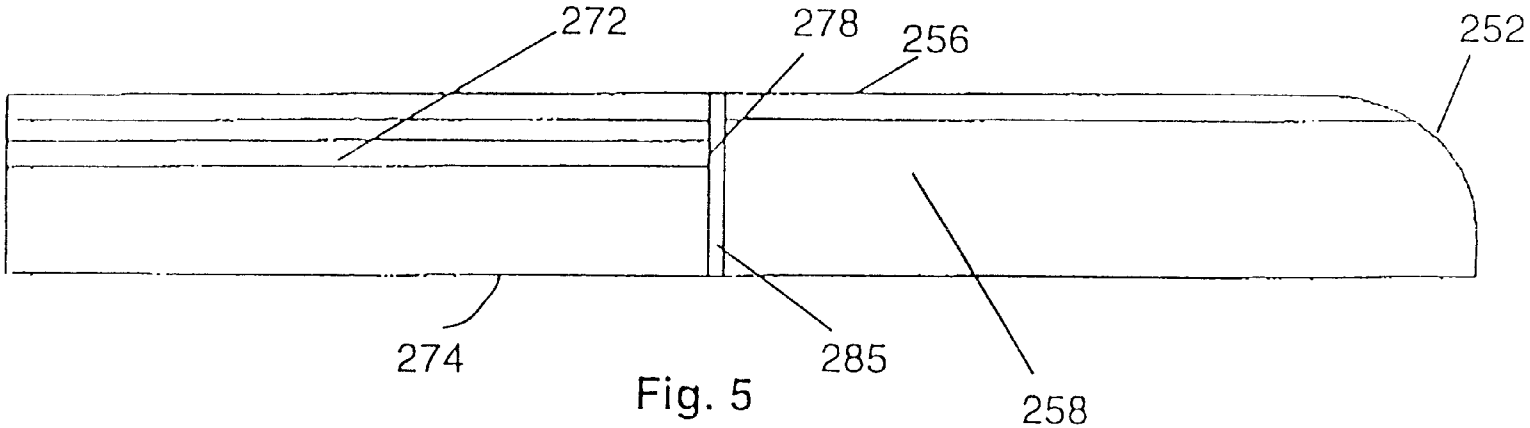
FIG. 5 is a drawing showing a detailed view of a side wall of a tray having a moveable support member, in accordance with one embodiment of the invention.
Figure 10:
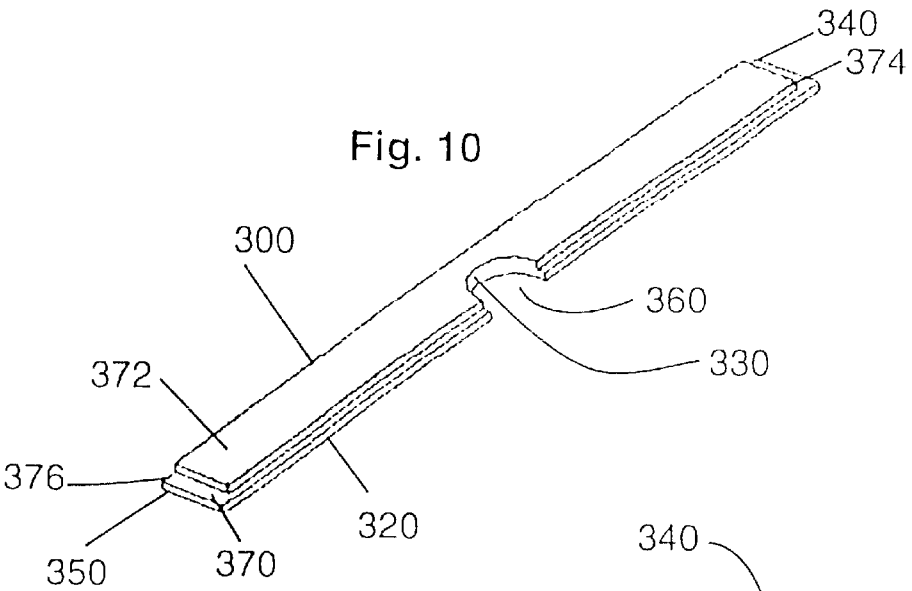
FIG. 10 is a drawing showing a perspective view of the back of a tray having a moveable support member, in accordance with one embodiment of the invention.
Figure 9:
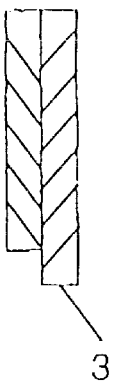
FIG. 9 is a drawing showing a detailed view of a cross section of one back end of the back of a tray having a moveable support member, in accordance with one embodiment of the invention.
Figure 11:
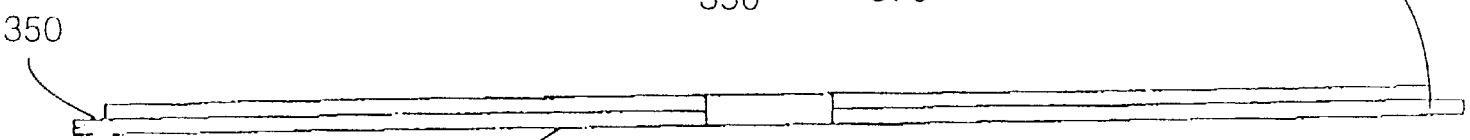
FIG. 11 is a drawing showing a detailed view of a lower back edge of the back of a tray having a moveable support member, in accordance with one embodiment of the invention.
Figure 8:
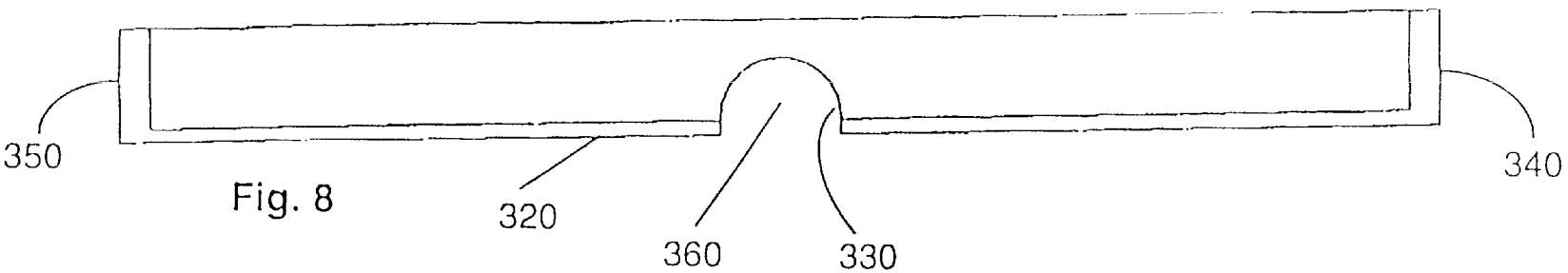
FIG. 8 is a drawing showing a detailed view of a back of a tray having a moveable support member, in accordance with one embodiment of the invention.

The back side wall ends 204, 254 abut the back ends 340, 350. The side wall bases 224, 274 abut the base sides 120, 130 with the inner side wall portions 208, 258 adjacent the base support surface 110. The side walls 220, 250 extend upward from the base 10 with the inner side wall portions 208 and 258 terminating at a level below the outer side wall portions 226, 276 creating recessed side wall edges 220, 270. Each side wall 200, 250 has a slot 222, 272 positioned on the inner side wall portion 208, 258 below the recessed side wall edge 220, 270. The side walls 222, 250 are shown in further detail in FIG. 5. As shown in FIG. 5, the slots 220, 272 extend a portion of the length of the side walls 220, 250. The slot ends 228, 278 limit the forward motion of the support member 500. In the exemplary embodiment shown in FIG. 3., the slot ends are formed by vertical grooves 280, 285 in the inner side wall portion 208, 258. The forward motion of the support member 500 is limited either by the inner side wall portion 208, 258 adjacent the grooves 280, 385 or by positioning a blocking device in the groove. Optionally, the grooves 280, 285 could be omitted with the inner side wall portions 208, 258 limiting the forward motion of the support member 500 at slot ends 228 and 278, or grooves 280, 285 could be omitted and a blocking device could be inserted in the slot 222, 272 to limit and/or adjust the forward motion of the support member 500, for example. The recessed side wall upper edges 220, 270 contact and provide support to the support member 500, for example when the support member 500 is in its substantially horizontal position as well as when the support member 500 is in its vertical position.

Returning to FIG. 3, the support bar 400 has support bar ends 420, 430, groove 440, pivot pin receptor positions 450, pivot pens 470. The support bar ends 420, 430 abut the slots 222, 272. Each support bar end 420, 430 has a pivot pin receptor position 450 for receiving a pivot pin 470. When the pivot pins 470 are inserted and the tray assembled, the pivot pins 470 are moveable within the slot 228, 278. Thus, the support bar 400 may be slid forward and backward along the slot and rotated about an axis defined by the pivot pin position. A pivot pin is shown in the exemplary embodiment, however, alternatively, a dowel block or rod, for example, could project from the support bar ends 420, 430 to connect with the slot and permit movement.

As one skilled in the art will appreciate, a pivot pin slot arrangement is only one example of an arrangement which would allow the desired forward and back movement and rotational movement of the support bar 400. For example, a track combined with a ball or wheel having the ball or wheel positioned in the track and the ball or wheel connected to the support bar ends 420, 430 is an alternative option.

Figure 13:
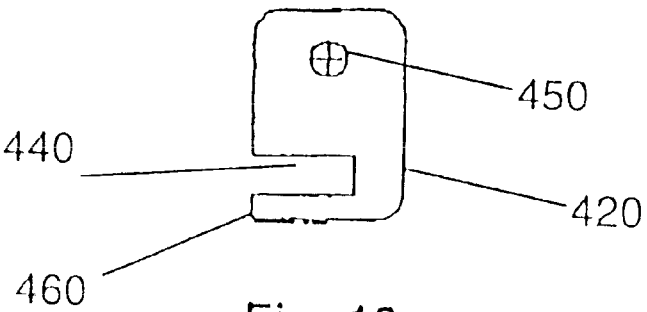
FIG. 13 is a drawing showing a detailed view of one end of a support bar of a tray having a moveable support member, in accordance with one embodiment of the invention.
Figure 12:
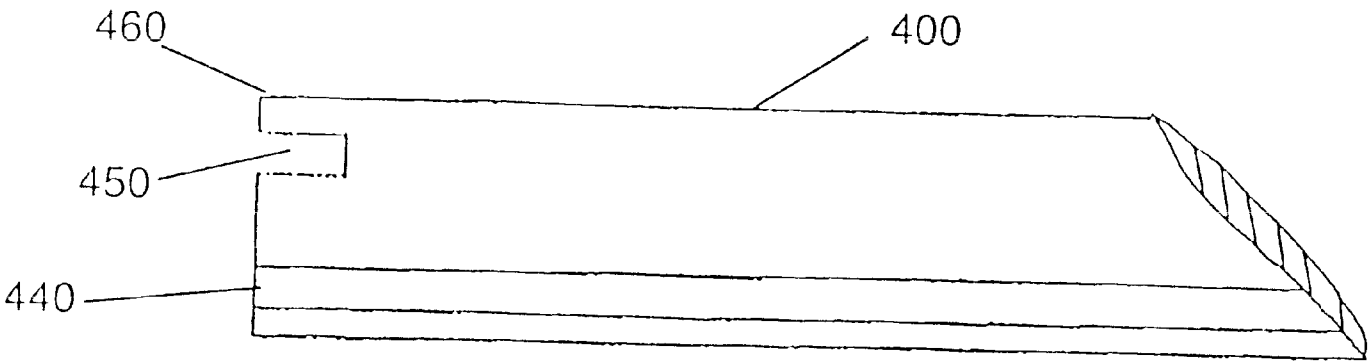
FIG. 12 is a drawing showing a detailed view of a support bar of a tray having a moveable support member, in accordance with one embodiment of the invention.

As shown in FIGS. 12 and 13, the support bar 400 has a groove 440 which extends the length of the support bar 400. This groove 440 mates with a portion of the support member 500. The groove is positioned such that a support bar front rim 460 is formed between the groove 440 and an edge of the support bar 400. When the groove 440 is mated with a portion of the support member 500 and the support member 500 is in its substantially upright position, the support bar front rim 460 forms a base for supporting lower edge of copy positioned adjacent the support member 500.

Referring to FIG. 3 and FIG. 14, the support member 500 has a lower support member edge 510, a pair of support member sides 520, 530, a support member front surface 540 and a support member back surface 550 and a pair of support member position adjustment notches 560, 570. The lower support member edge 510 is affixed in the groove 440 of the support bar 400 in an assembled tray 10. Thus, as the support bar 400 moves the support member 500 moves. The combined back to front movement and rotational movement of the support bar 400 permits the support member 500 to be moved from a substantially upright position to a substantially horizontal position when the support bar 400 is moved along the slots 222, 272 and rotated about the axis defined by the pivot pin 470.

As shown in FIG. 3 and in greater detail in FIG. 14, the support member 500 of the exemplary embodiment has a pair of position adjustment notches 560, 570. The position adjustment notches 560, 570 rest against the side wall tops 206, 256 when the support member is in the upright or substantially vertical position. Substantially vertical is taken to mean that the support member 500 is tilted at an angle such that one edge of support member surface 540 is elevated with respect to the opposite edge of support member surface 540. The positioning of the adjustment notches 560,570 against the side wall tops 560, 570 permits the substantially upright support member 500 to be tilted at an angle other than 90 with respect to the base. A tilt of the support member 500 facilitates positioning copy against the support member. Further, the positioning of the position adjustment notches 560, 570 against the side wall tops 206, 256 serves to hold the support member 500 in a substantially upright position and restrict undesirable movement of the support member 500 during the use of the support member 500 in its upright position.

It will be appreciated by those skilled in the art that the position adjustment notches 560, 570 are one exemplary embodiment of a pivot limit structure for positioning the support member 500 in the upright position and securing the position during use. Alternatively, other devices may be used. For example, a single prop may be positioned on the back of the support member. Alternatively, an at least one adjustable fastener or a notched device may be affixed to the support member 500 to permit selection of a tilt from a plurality of possible tilt positions. Alternatively, an at least one spring device may be utilized to select and secure the upright position of support member 500, for example.

Additionally, it will be appreciated by one skilled in the art that the pivot limit structure may alternately be positioned on the support bar 400 or on the side walls 200, 250.

Further, it will be appreciated by one skilled in the art that the components of tray 10 shown in FIG. 3 are representative of one exemplary embodiment. Other configurations of components may be used. For example, the support member 500 and the support bar 400 could be formed as a single piece or platform having portions which form a support member portion and portions which form a support bar portion. Alternatively, the side walls 200, 250, back 300 and base 100 could be formed as a single piece, for example. Such combinations may be desirable in embodiments constructed from polymeric materials, for example.

Optionally, as shown in FIGS. 15 and 16, features which facilitate the use of the tray as a workstation may be included. As FIG. 15 shows the tray 10, may include divider strips 702 which create storage compartments 700 in the tray 10. As one skilled in the art will appreciate the numbers and arrangement of the divider strips is subject to many variations and the exemplary embodiment shown in FIG. 15 is only one example of the many possible arrangements. The divider strips 702 have a height less than or equal to the side walls 200, 250. Further, the divider strips 702 may be mounted in a fixed position or notches may be provided in the divider strips 702, side walls 200, 250 or back 300 such that the divider strips are held in position by fitting the ends of a divider strip into notches. The notch arrangement may provider the user with the option to reconfigure the divider strips 702 to customize the storage compartments 700 or accommodate variously sized pieces of computer equipment, foe example.

A front divider strip 706 may be positioned paralleled to the back 300. This front divider strip further includes a divider strip aperture 704. The divider strip aperture 704 is in alignment with the back aperture 360. This provides a passage for confining and directing cords of the type associated cords computer equipment, for example.

In accordance with the exemplary embodiment of the invention shown in FIGS. 15 and 16, the tray 10 may include a front 720. The front 720 has a lower front edge 724 and a front inner wall 722. The lower front edge 724 of the front 720 is attached to the base 100 by hinges 710. The front 720 may be positioned such that the front inner wall 722 is normal to the base 100 or alternatively aligned with base 100. In embodiments having a front 720 it is desirable that the front sidewall ends 202, 252 are shaped to abut the front 720. In the exemplary embodiment shown in FIG. 15, the front sidewall ends 202, 252 are rectangular and abut the front inner wall 722 along the entire front side wall ends 202, 252, The front inner wall 722 of the front 720 may be optionally equipped with a wrist support 730.

The tray may be used as a stand alone device, positioned in a drawer or mounted in a fixed position to another object such as a piece of furniture.

It will therefore be readily understood by those persons skilled in the art that the present invention is susceptible over a broad utility and application. Many embodiments and adaptations of the present invention other than those herein described, as well as many variations, modifications and equivalent arrangements, will be apparent from or reasonably suggested by the present invention in the foregoing description thereof, without departing from the substance or scope of the present invention.

Accordingly, while the present invention has been described herein in detail in relation to its exemplary embodiments, it is to be understood that this disclosure is only illustrative and exemplary of the present invention and it has made merely for the purpose of providing a full and enabling disclosure of the invention. The foregoing disclosure is not intended to be construed to limit the present invention or otherwise to exclude any such other embodiments, adaptations, variations, modifications and equivalent arrangements, the present invention being limit only by the claims.

What is claimed is:

1. An adjustable tray comprising:

a base having a first base side and a second base side, the base having a base support surface extending between the first base side and the second base side;

a first support attached to the first base side, the first support having a length and including a first support slot extending along a portion of the first support;

a second support attached to the second base side, the second support having a length and including a second support slot extending along a portion of the length of the second support;

a platform having opposing ends, the platform further including two projections disposed at each respective end of the platform, the projections extending into the first support slot and the second support slot; and a front panel connected to the base, wherein a wrist support is attached to a surface at the front panel.

2. The adjustable tray according to claim 1, wherein the projections are each pins extending from the respective ends of the platform.

3. The adjustable tray according to claim 1, wherein the platform includes a pivot limit structure, the pivot limit structure limits pivotable movement of the platform relative to the first and second supports.

4. The adjustable tray according to claim 3, wherein:

each pivot limit structure includes a contact surface;

each of the first support and the second support includes respective upper surfaces extending along the length of the first and second support respectively; and wherein the contact surface of each pivot limit structure contacts the respective upper surface to limit pivotable movement of the platform relative to the first and second supports.

5. The adjustable tray according to claim 1, wherein the base includes a pivot limit structure, the pivot limit structure limits pivotable movement of the platform relative to the first and second supports.

6. The adjustable tray according to claim 1, wherein at least one of the first and second supports includes a pivot limit structure, the pivot limit structure limits pivotable movement of the support bar relative to the first and second supports.

7. The adjustable tray according to claim 1, wherein at least one divider strip is disposed on the base.

8. An adjustable tray comprising:

a base having a first base side and a second base side, the base having a base support surface extending between the first base side and the second base side;

a first support attached to the first base side, the first support having a Length and including a first slot extending along a portion of the first support;

a second support attached to the second base side, the second support having a length and including a second slot extending along a portion of the length of the second support; and a platform, the platform including:

a support member portion having an edge extending from a first side to a second side of the support member portion, the support member portion further having a front support member surface and a back support member surface; and a support bar portion having opposing ends, the support bar portion fixedly connected to and extending along the lower edge of the support member portion, the support bar portion further including two projections disposed at each respective end of the support bar, two projections extending into the first support slot and the second support slot, wherein the support bar portion includes a groove extending along a length of the support bar, the lower edge of the support member portion extending into the groove.

9. The adjustable tray according to claim 8, wherein the projections are each pins extending from the respective ends of the support bar.

10. The adjustable tray according to claim 8, wherein an upper surface of the support bar portion extends beyond the front support member surface of the support member portion defining a ledge.

11. The adjustable tray according to claim 8, wherein the support bar portion and the support member portion are integrally formed.

12. The adjustable tray according to claim 8, wherein each support member portion includes a pivot limit structure, the pivot limit structure limits pivotable movement of the support bar portion and the support member portion relative to the first and second supports.

13. The adjustable tray according to claim 12, wherein:

each pivot limit structure includes a contact surface;

each of the first support and the second support includes respective upper surfaces extending along the length of the first and second support respectively; and wherein the contact surface of each pivot limit structure contacts the respective upper surface to limit pivotable movement of the support bar portion and the support bar member portion relative to the first and second supports.

14. The adjustable tray according to claim 8, wherein the support bar portion includes a pivot limit structure, the pivot limit structure limits pivotable movement of the support bar portion relative to the first and second supports.

15. The adjustable tray according to claim 8, wherein at least one of the first and second supports includes a pivot limit structure, the pivot limit structure limits pivotable movement of the support bar relative to the first and second supports.

16. The adjustable tray according to claim 8, wherein the base includes a pivot limit structure, the pivot limit structure limits pivotable movement of the platform relative to the first and second supports.

17. The adjustable tray according to claim 8, further including a front panel connected to the base.

18. The adjustable tray according to claim 17, wherein a wrist support is attached to a surface at the front panel.

19. The adjustable tray according to claim 8, wherein at least one divider strip is disposed on the base.

20. An adjustable tray, the tray comprising:

a base having a first base edge and a second base edge, wherein the first base edge is parallel to the second base edge;

a first support attached to the first base edge;

a second support attached to the second base edge; a support member;

a front panel connected to the base, wherein a wrist support is attached to a surface at the front panel; and means for providing slidable and rotatable connection of the support member with the first support and the second support.

21. The adjustable tray according to claim 20, wherein the support member includes a pivot limit structure, the pivot limit structure limits pivotable movement of the support member structure to the first and second supports.

22. The adjustable tray according to claim 20, wherein the base includes a pivot limit structure, the pivot limit structure limits pivotable movement of the support member relative to the first and second supports.

23. The adjustable tray according to claim 20, wherein the at least one of the first and second supports includes a pivot limit structure, the pivot limit structure limits pivotable movement of the support member relative to the first and second supports.

24. The adjustable tray according to claim 20, wherein at least one divider strip is disposed on the base.

25. An adjustable tray, the tray comprising:

a base having a first base edge, a second base edge and a base back edge, wherein the first base edge is parallel to the second base edge;

a back attached to the base back edge, the back including a back aperture;

a divider strip, the divider strip including a divider strip aperture and wherein the divider strip is disposed on the base and parallel to the back such that the divider strip aperture is in alignment with the back aperture;

a first support attached to the first base edge; a second support attached to the second base edge;

a support member; and means for providing slideable and rotateable connection of the support member with the first support and the second support.

26. An adjustable tray comprising:

a base having a first base side and a second base side, the base having a base support surface extending between the first base side and the second base side;

a first support attached to the first base side, the first support having a length and including a first slot extending along a portion of the first support;

a second support attached to the second base side, the second support having a length and including a second slot extending along a portion of the length of the second support; and a platform, the platform including:

a support member portion having an edge extending from a first side to a second side of the support member portion, the support member portion further having a front support member surface and a back support member surface;

a support bar portion having opposing ends, the support bar portion fixedly connected to and extending along the lower edge of the support member portion, the support bar portion further including two projections disposed at each respective end of the support bar, two projections extending into the first support slot and the second support slot; and a front panel connected to the base, wherein a wrist support is attached to a surface at the front panel.

* * * * *